US006088987A

United States Patent [19]

Simmons et al.

[11] Patent Number: 6,088,987

[45] Date of Patent: Jul. 18, 2000

[54] MODULAR BUILDING MATERIALS

[76] Inventors: Scott Simmons, 27252 Lower Pleasant Ridge Rd., Wilder, Id. 93676; Gary D. Simmons, P.O. Box 688, Lincoln, Calif. 95648-0688

[ * ] Notice: This patent issued on a continued prosecution application filed under 37 CFR 1.53(d), and is subject to the twenty year patent term provisions of 35 U.S.C. 154(a)(2).

[21] Appl. No.: 08/770,870

[22] Filed: Dec. 20, 1996

Related U.S. Application Data

[60] Provisional application No. 60/009,293, Dec. 21, 1995.

[51] Int. Cl.[7] ..... E04B 2/20

[52] U.S. Cl. ..... 52/592.6; 52/585.1; 52/592.1; 52/592.4; 52/592.5; 52/604; 52/605; 52/607; 52/608; 405/285; 405/286

[58] Field of Search ..... 52/245, 247, 293.2, 52/585.1, 592.1, 592.6, 592.4, 600, 604, 605, 606, 607, 608, 592.5; 405/286, 285; 446/102, 108, 115, 121, 122, 125

[56] References Cited

U.S. PATENT DOCUMENTS

| | | | |
|---|---|---|---|
| 2,262,199 | 11/1941 | Paulson . | |
| 2,826,906 | 3/1958 | Rice . | |
| 3,030,093 | 4/1962 | Reintjes . | |
| 3,618,279 | 11/1971 | Sease . | |
| 4,107,894 | 8/1978 | Mullins . | |
| 4,297,816 | 11/1981 | Kella . | |
| 4,436,447 | 3/1984 | Crowe | 52/592.1 X |
| 4,573,301 | 3/1986 | Wilkinson . | |
| 4,740,189 | 4/1988 | Bertrand | 446/128 |
| 4,965,979 | 10/1990 | Larrivee et al. . | |
| 4,996,813 | 3/1991 | Kliethermes, Jr. et al. | 52/592.1 |
| 5,003,746 | 4/1991 | Wilston . | |
| 5,421,135 | 6/1995 | Stevens et al. | 51/606 X |
| 5,537,796 | 7/1996 | Kliethermes, Jr. | 52/592.6 |
| 5,651,642 | 7/1997 | Kenog, Jr. et al. | 52/592.6 X |

OTHER PUBLICATIONS

Designation C 55–95a, "Standard Specification for Concrete Building Brick", Annual Book of American Society for Testing and Materials (ASTM) Standards, Jan., 1996, pp. 29–31, Conshohocken, PA.

Designation C 90–96, "Standard Specification for Loadbearing Concrete Masonary Units", Annual Book of American Society for Testing and Materials (ASTM) Standards, Apr., 1996, pp. 71–74, Conshohocken, PA.

Designation C 129–96, "Standard Specifcation for Nonloadbearing Concrete Masonry Units", Annual Book of American Society for Testing and Materials (ASTM) Standards, Apr., 1996, pp. 86–88, Conshohocken, PA.

Designation C 426–96, "Standard Test Method for Linear Drying Shrinkage of Concrete Masonry Units", Annual Book of American Society for Testing and Materials (ASTM) Standards, Apr., 1996, pp. 241–245, Conshohocken, PA.

(List continued on next page.)

*Primary Examiner*—Carl D. Friedman
*Assistant Examiner*—Yvonne M. Horton
*Attorney, Agent, or Firm*—Jeffrey D. Myers; Deborah A. Peacock

[57] ABSTRACT

Building materials of modules of at least one mortise and tenon and either a curvilinear side face or joinder of the modules at angles other than zero and ninety degrees. Lateral ends of the modules are flush with lateral ends of adjacent modules. Preferably, the modules are: (1) of a low density aggregate cementitious mix; and/or (2) have a hollow space extending from the mortise to the tenon and include a structural support member passing through the hollow space and a compression retainer securing the structural support member to the modules; and/or (3) have grooves circumscribing the modules and which are proximate corresponding grooves on modules placed on top or below. The modules are preferably sealed to one another with sealant placed in the grooves.

41 Claims, 13 Drawing Sheets

OTHER PUBLICATIONS

Designation C 1006–84 (Reapproved 1990), "Standard Test Method for Splitting Tensile Strength of Masonry Units", Annual Book of American Society for Testing and Materials (ASTM) Standards, Feb., 1984, pp. 650–652, Conshohocken, PA.

Designation C 1072–94, "Standard Test Method for Absorption of Architectural Cast Stone", Annual Book of American Society for Testing and Materials (ASTM) Standards, vol. 04.05, Dec., 1994, pp. 658–663, Conshohocken, PA.

Designation C 1195–91 (Reapproved 1995), "Standard Test Method for Measurement of Masonry Flexible Bond Strength", Annual Book of American Society for Testing and Materials (ASTM) Standards, Oct., 1991, pp. 770–771, Conshohocken, PA.

Designation C 1196–924, "Standard Test Method for In Situ Compressive Stress Within Solid Unit Masonry Estimated Using Flatjack Measurements", Annual Book of American Society for Testing and Materials (ASTM) Standards, May, 1992, pp. 772–776, Conshohocken, PA.

Designation c 1197–92, "Standard Test Method for In Situ Measurement of Masonry Deformability Properties Using Flatjack Measurements", Annual Book of American Society for Testing and Materials (ASTM) Standards, May, 1992, pp. 777–781 Conshohocken, PA.

Designation C 1209–95, "Standard Terminology of Concrete Masonry Units", Annual Book of American Society for Testing and Materials (ASTM) Standards, Apr., 1995, p. 792 Conshohocken, PA.

Designation C 1262–95, "Standard Test Method for Evaluating the Freeze–Thaw Durability of Manufactured Concrete Masonry Units and Related Concrete Units", Annual Book of American Society for Testing and Materials (ASTM) Standards, Apr., 1995, pp. 827–829 Conshohocken, PA.

Designation c 1314–95, "Standard Test Method for Constructing and Testing Masonry Prisms Used to Determine Compliance with Specified Compressive Strength of Masonry", Annual Book of American Society for Testing and Materials (ASTM) Standards, Feb. 1996, pp. 853–855, Conshohocken, PA.

Designation E 447–92b, "Standard Test Methods for Compressive Strength of Masonry Prisms", Annual Book of American Society for Testing and Materials (ASTM) Standards, Dec., 1992, pp. 987–990, Conshohocken, PA.

Designation E 514–90, "Standard Test Methods for Water Penetration and Leakage Through Masonry", Annual Book of American Society for Testing and Materials (ASTM) Standards, Sep., 1990, pp. 991–994, Conshohocken, PA.

Designation E 518–80 (Reapproved 1993), "Standard Test Methods for Flexural Bond Strength of Masonry", Annual Book of American Society for Testing and Materials (ASTM) Standards, Dec., 1992, pp. 995–998, Conshohocken, PA.

Designation E 519–81 (Reapproved 1993), "Standard Test Methods for Diagonal Tension (Shear) in Masonry Assemblages", Annual Book of American Society for Testing and Materials (ASTM) Standards, Oct., 1981, pp. 987–990, Conshohocken, PA.

"1996 Annual Book of ASTM Standards", Annual Book of American Society for Testing and Materials (ASTM) Standards, Section 4, Construction, vol. 04.02, pp. 1–690, Conshohocken, PA., 1996.

1996 Annual Book of ASTM Standards, Amer Soc for Testing and Materials, vol. 04.01 "Concrete and Aggregates," pp. x–xiii (1996).

1996 Annual Book of ASTM Standards, Amer Soc for Testing and Materials, vol. 04.05 "Chemical–Resistant Materials; Vitrified Clay, Concrete, Fiber–Cement Products; Mortars; Masonry," pp. x–xiv (1996).

52

53

54

55

56

57

58

59

60

61

62

63

64

65

66

67

68

69

70

71

72

73

74

MODULAR BUILDING MATERIALS

CROSS-REFERENCE TO RELATED APPLICATIONS

This application claims the benefit of the filing of Provisional Application Ser. No. 60/009,293, entitled Building System, filed on Dec. 21, 1995.

BACKGROUND OF THE INVENTION

1. Field of the Invention (Technical Field)

The present invention relates to a system of mortarless, interlocking building modules for rapid construction of architecturally varied walls. The modules in the invention preferably employ ultra low density materials, such as concrete utilizing expanded perlite as an aggregate.

2. Background Art

The world is rigorously searching for alternative building materials and methods that can be used in place of diminishing forest resources. The use of forest products for building materials is causing a great deal of environmental damage as well as political stress.

This invention can replace the standard method of building walls with wood framing, vapor barriers, and insulation. Low density concrete mixtures can serve as ah alternative building material to satisfy a percentage of the current demand for building materials. Walls built with these low density cementitious mixes may be load bearing if the load to be carried is spread out over sufficient area. Low density concretes have high R-values so walls built with them, if thick enough, would not need the additional step of adding insulation. This invention modularizes this material into a user friendly, versatile, architecturally flexible system.

Typical of prior art modular building materials are U.S. Pat. No. 4,297,816, entitled "Interlocking Construction Block", to Kella, et al.; U.S. Pat. No. 5,421,135, entitled "Interlocking Building Blocks", to Stevens, et al.; U.S. Pat. No. 5,003,746, entitled "Arcuate and Curvilinear Assemblies Comprising Tandemly Arranged Building Blocks Having Degrees of Rotation", to Wilston; U.S. Pat. No. 4,965,979, entitled "Concrete Block Wall", to Larrivee, et al.; U.S. Pat. No. 4,573,301, entitled "Interlocking Building Blocks", to Wilkinson; U.S. Pat. No. 4,107,894, entitled "Interlocking Cementitious Building Blocks", to Mullins; U.S. Pat. No. 3,618,279, entitled "Building Block", to Sease; U.S. Pat. No. 3,030,093, entitled "Checkerwork", to Reintjes; U.S. Pat. No. 2,826,906, entitled "Wall of Building Blocks", to Rice; and U.S. Pat. No. 2,262,199, entitled "Toy Building Brick", to Paulson. Interlocking blocks of the type shown in the above patents are unsatisfactory for varying reasons, including inability to sustain high loads, no provision for post tensioning, inadequate sealing or insulating properties, little or no flexibility in varying shapes and designs to fit construction needs, and no means to allow end users to easily design structures. The invention utilizes as much of the interior space of the block as possible while still providing channels for utility routing, bond beam reinforcement, and the post-tension apparatus. The prior art requires blocks that have larger open areas within the block, requiring mixes or materials of higher psi ratings than with the present invention. More filled area means more square inches of surface area to carry load on. The present invention requires lower skill to construct than prior art systems, and requires fewer steps to construct a finished structure. Instead of having to first erect the structure by traditional wood framing techniques, then add insulation, sheathing, vapor barrier, inside finish treatment, and exterior finish treatment, the method of the present invention greatly simplifies that process. The blocks combine the framing, vapor barrier and insulation steps while providing a load-bearing system of walls for a structure.

SUMMARY OF THE INVENTION (DISCLOSURE OF THE INVENTION)

The present invention is of building materials comprising modules comprising a perlite aggregate and comprising at least one mortise and tenon. In the preferred embodiment, structures are constructed from interlocking modules. The modules preferably include one or more of the following: flat modules; flat half modules; flush end flat modules; flush end flat half modules; flat bond beam modules; flat bond beam half modules; flat flush end bond beam modules; flat flush end bond beam half modules; flat bullnose modules; flat bullnose half modules; flat modules with overhang; flat half modules with overhang; right and left hand corner modules with overhang; flat radius corner modules; corner half modules; ninety degree modules; angle modules; double angle modules; arch components; circle components; window modules; window header modules; door modules; door header beam modules; window sill modules; column segment modules; double bullnose flush end flat modules; double bullnose flush end flat half modules; straight to radius interface modules; slanted modules; trapezoidal modules; and gable roof filler modules. The modules comprise elongated depressions which are proximate corresponding elongated depressions on modules placed on top or below the modules, by means of which the modules may be sealingly affixed to one another, as well as elongated depressions in which elongated structural support elements may be placed. A hollow space extends from the mortise on a face of the module to the tenon on an opposite face of the module, and a structural support member may pass through the hollow space and a compression retainer used to secure the structural support member to the module. A miniaturized plurality of units corresponding to the shape and configuration of the full-size modules are preferably employed, the units being useful in designing structures to be fabricated from the modules. Each miniaturized unit comprises a marking corresponding to a marking on equivalent full-sized modules. The building materials comprise a compressive strength of at least 250 psi.

The invention is additionally of building materials comprising interlocking modules comprising at least one mortise and tenon, wherein at least one module comprises a side face which is curvilinear. In the preferred embodiment, structures are constructed from interlocking modules. The modules preferably include one or more of the following: flat modules; flat half modules; flush end flat modules; flush end flat half modules; flat bond beam modules; flat bond beam half modules; flat flush end bond beam modules; flat flush end bond beam half modules; flat bullnose modules; flat bullnose half modules; flat modules with overhang; flat half modules with overhang; right and left hand corner modules with overhang; flat radius corner modules; corner half modules; ninety degree modules; angle modules; double angle modules; arch components; circle components; window modules; window header modules; door modules; door header beam modules; window sill modules; column segment modules; double bullnose flush end flat modules; double bullnose flush end flat half modules; straight to round interface modules; slanted modules; trapezoidal modules; and gable roof filler modules. The modules comprise elongated depressions which are proximate corresponding elongated depressions on modules placed on top or below the modules, by means of which the modules may be sealingly affixed to one another, as well as elongated depressions in which elongated structural support elements may be placed. A hollow space extends from the mortise on a face of the module to the tenon on an opposite face of the module, and a structural support member may pass through the hollow space and a compression retainer used to secure the structural support member to the module. A miniaturized plurality of units corresponding to the shape and configuration of the full-size modules are preferably employed, the units being useful in designing structures to be fabricated from the modules.

The invention is also of building materials comprising a plurality of modules and a miniaturized plurality of units corresponding to the shape and configuration of the full-sized modules, the units being useful in designing structures to be fabricated from the modules. In the preferred embodiment, the miniaturized plurality of units each comprise a marking corresponding to a marking on their larger equivalent modules.

A primary object of the present invention is to provide an interlocking set of thermally efficient, load bearing construction blocks or modules which may be readily adapted for a wide variety of architectural configurations.

A primary advantage of the present invention is that it renders low density concretes utilizing perlite, or other lightweight aggregates, useful for construction of a wide variety of structures.

Other objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated into and form a part of the specification, illustrate several embodiments of the present invention and, together with the description, serve to explain the principles of the invention. The drawings are only for the purpose of illustrating a preferred embodiment of the invention and are not to be construed as limiting the invention. In the drawings.

Figure 1:
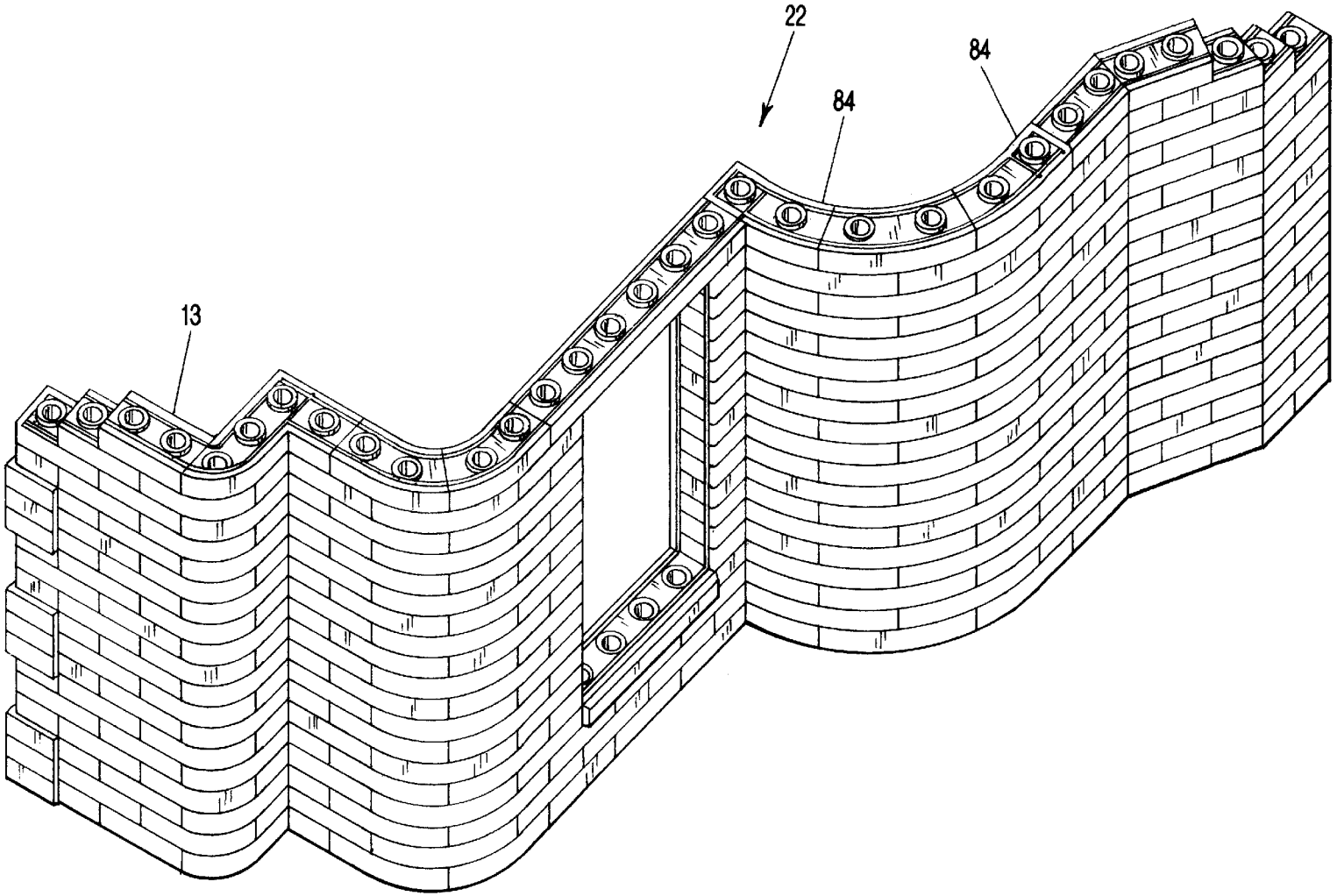
FIG. 1 is a perspective view of a single-layer wall constructable according to the invention embodying several possible architectural or design features of the invention.

DESCRIPTION OF THE PREFERRED EMBODIMENTS (BEST MODES FOR CARRYING OUT THE INVENTION)

The present invention is of an interlocking system of modular building components to be used in the construction of walls or other structures. These components, also referred to herein as modules, elements, blocks, or units, are useful for structural walls or forms, in buildings, decorative walls or forms, and barriers. The invention is a combination of interlocking, self-sealing, mortarless, preferably lightweight and cementitious, modules. The modules in this system are designed as a pre-manufactured, pre-engineered set of architectural elements capable of building structures that are flat, angled, curved, and round. The term "wall" as used throughout the specification and claims is intended to include walls and any other assembled structures created by the interlocked blocks.

The dimensions and spacing of the mortices and tenons that create the lateral interlocking mechanism between the modules when stacked one on top of the other is specific to this invention. The exact dimension and spacing of mortices and tenons are common to each component so that, when assembled, each will readily interlock with any other component within the system.

The invention's components permit rapid construction of load bearing openings in walls, windows, doors, arches, and spanned openings for egress or architectural detail. This invention also includes interlocking segments capable of building round columns that when assembled and properly placed can be interlocked with the other components in the system.

The modules in the system are mortarless and secured by post-tensioning using hardware specific to this invention. The hardware is a system of threaded rods, retainer caps, threaded nuts, and washers. The post-tensioning rods are attached to anchors placed into the slab or foundation by threaded rod couplings or other mechanical devices.

The invention also includes miniature embodiments of all the full size modules. The purpose of the miniature modules is to facilitate the design and construction of a scale model of any proposed structure, facilitate the creation of a list of materials needed for a proposed design, and to enhance the marketability of the full size system.

The present invention includes an integrated system of post-tensioning. The design provides for lateral passage ways within an erected wall for utilities and bond beam applications and includes a wide range of architectural elements all designed to interconnect with each other based on a predetermined grid spacing.

The invention also permits commercialization for relatively low strength concretes utilizing low-strength, expanded aggregates. Again, the invention combines the labor-saving advantages of mortarless blocks with a post-tensioning system that can quickly secure an erected wall. The preferred cementitious modules maximize the use of the interior space of the mortarless block while still providing channels for utility routing and the post-tension apparatus.

Figure 7:
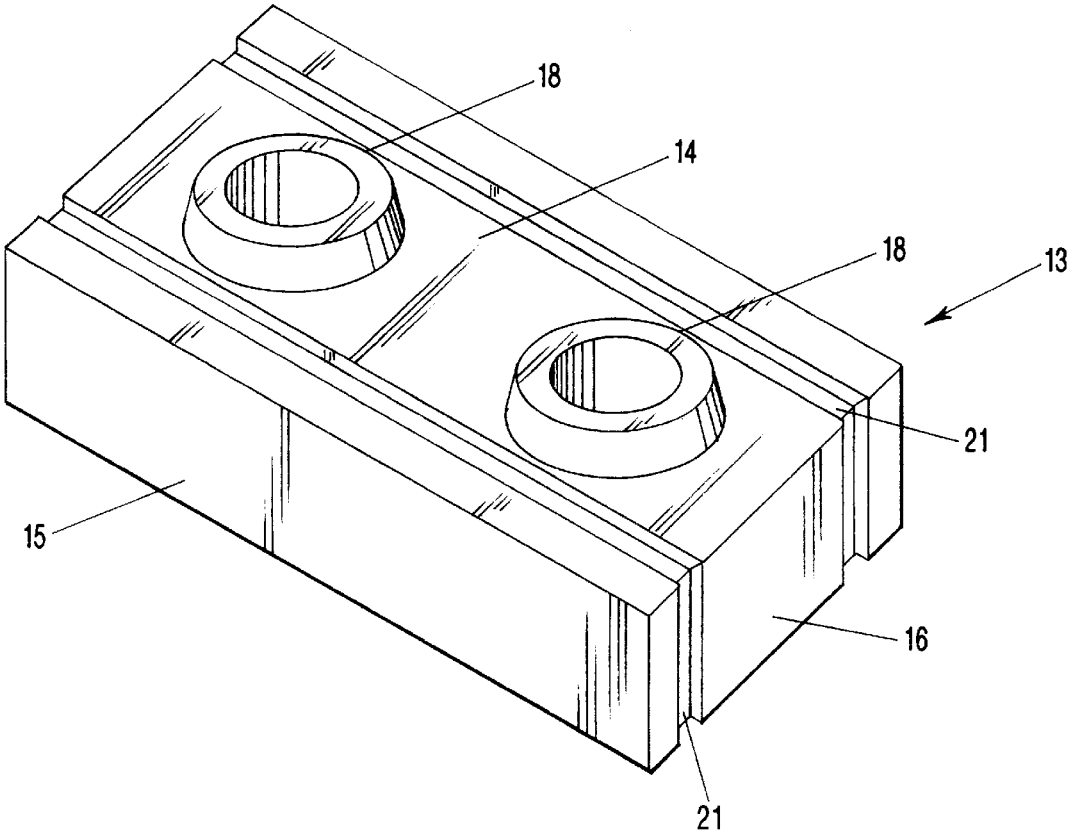
FIG. 7 is a perspective view of a standard block or module of the invention.
Figures 8A, 8B, 8C:
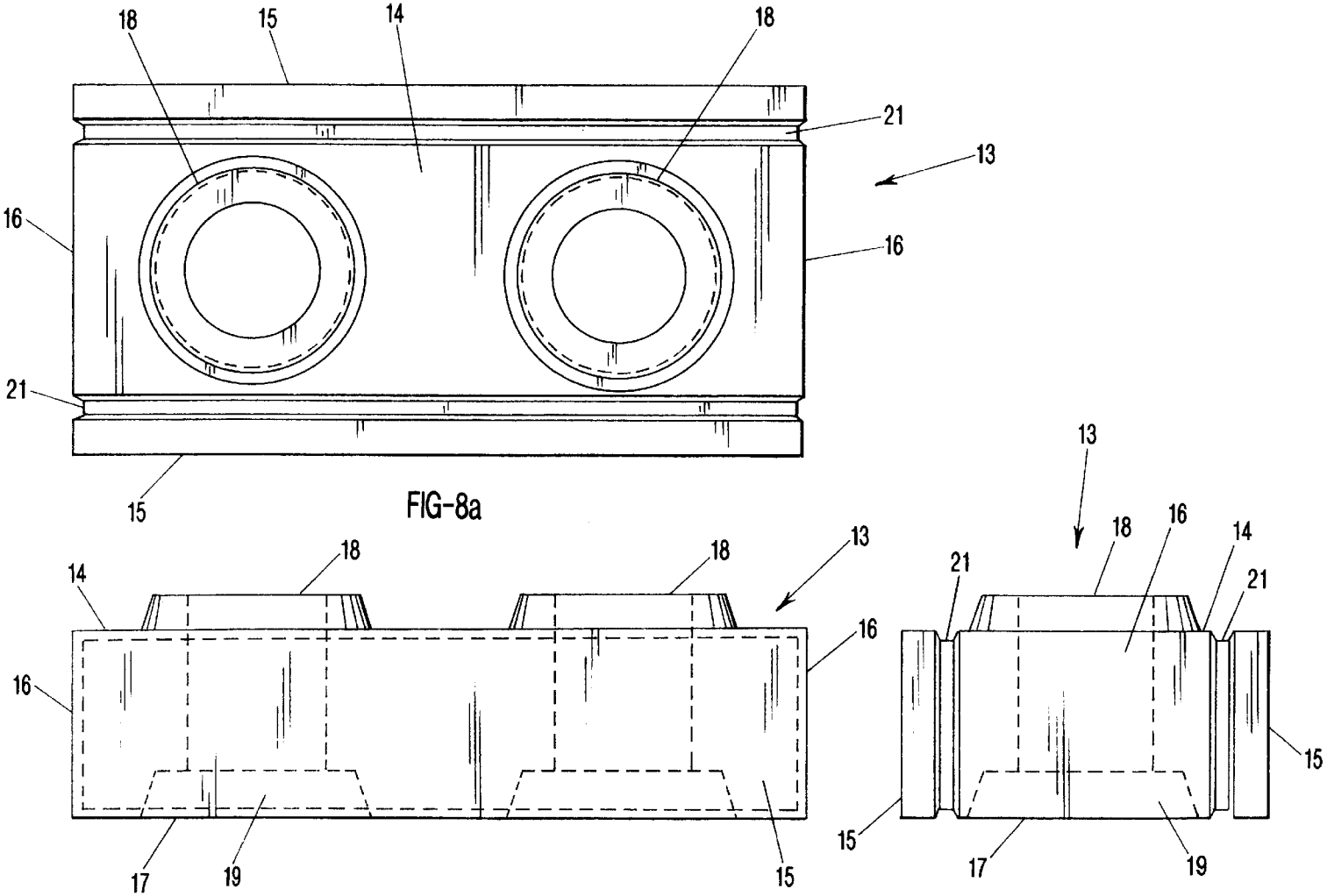
FIGS. 8(*a*)–(*c*) illustrate in top, side, and end views the standard block of FIG. 7.

As an initial example of the modules utilized to construct a structure 22 according to the present invention, FIGS. 7 and 8(*a*)–(*c*) show a standard, flat wall module 13 comprising a flat, horizontal top face 14, two vertical, parallel side faces 15, two vertical parallel end faces 16 and a flat horizontal bottom face 17. The module has on its top face 14, round, conical, flat topped, coaxially hollow tenons 18 that protrude upwards. On the bottom face 17 are mortises 19 that protrude inward and are axially aligned with the tenons 18 on the top face 14. The mortises 19 and tenons 18 are the same dimensions, equidistantly spaced along the length of the module 13, axially aligned and coaxially hollow. There are grooves 21 on the top, bottom, and end faces adjacent to the side faces 15 in such a manner that they connect one to another encircling the module 13 with one continuous groove on each side.

On the horizontal top face 14 two round conical tenons 18 extend upward, and are coaxially hollow. The hollow extends toward the bottom face 17 of the block. Before the hollow exits the block, it first passes through a mortise 19 in the bottom of the block that is shaped and aligned exactly like the tenons 18 on the top face. This allows the blocks to be stacked one on top of the other. The tenons on the top of one block fit into the mortises on the bottom of another block. These tenons and mortises are coaxially aligned with the hollows within them. When the blocks are stacked one on top of the other, equidistantly spaced tubular hollow spaces are created extending from one block to another for the height of the constructed wall.

Each block (but not bond beam modules and modules forming tops of walls) has two grooves 21 on the top, ends, and bottom. These grooves are placed in such a manner that they connect one to another thereby encircling the block with two continuous grooves placed towards the outer faces of the block. The grooves 21 of each block in a constructed wall will align one with another allowing the placement of a foam rubber extrusion, an injected elasto-polymer, or the like, if desired to create a sealed wall.

Figure 3:
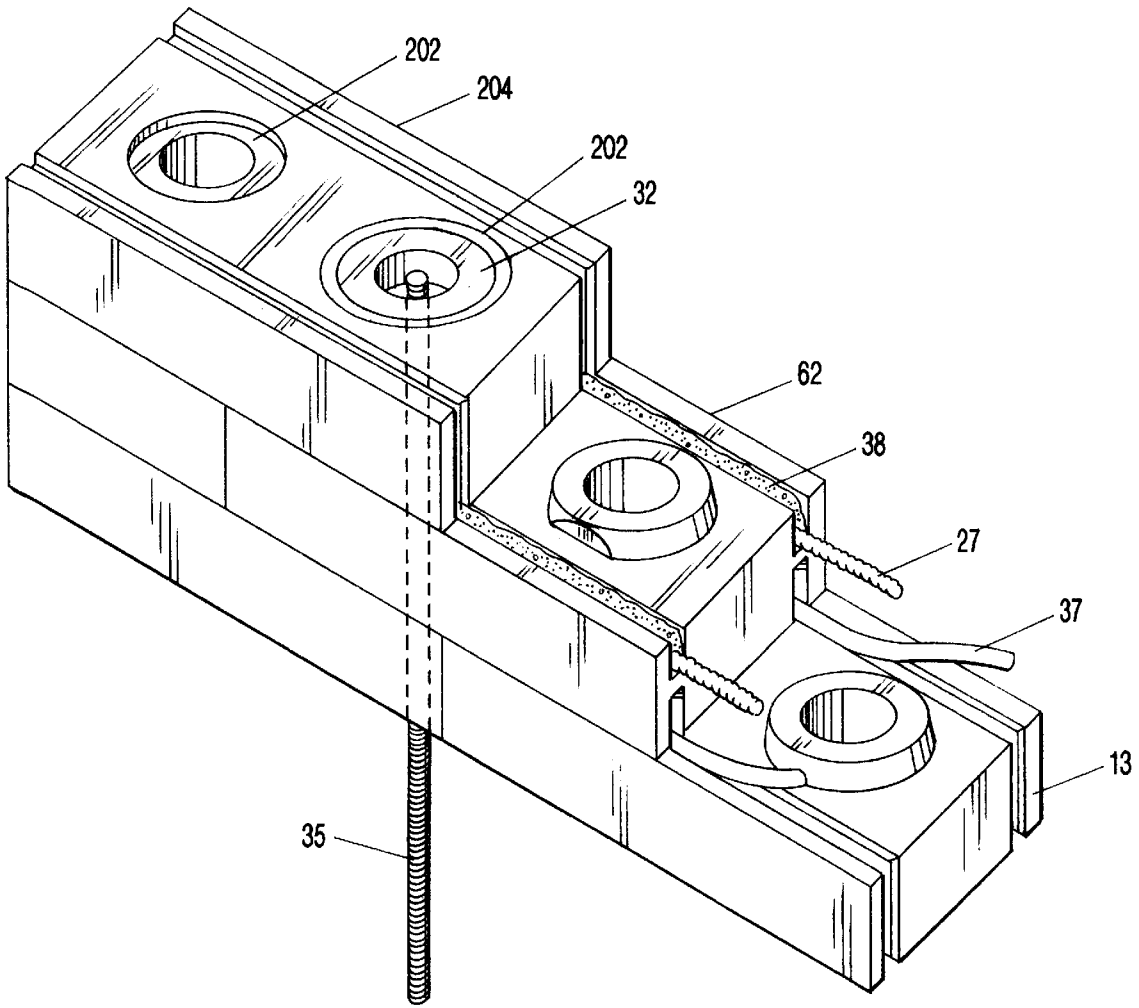
FIG. 3 is a see-through perspective view of the building modules illustrating the anchoring systems of the invention.
Figure 4:
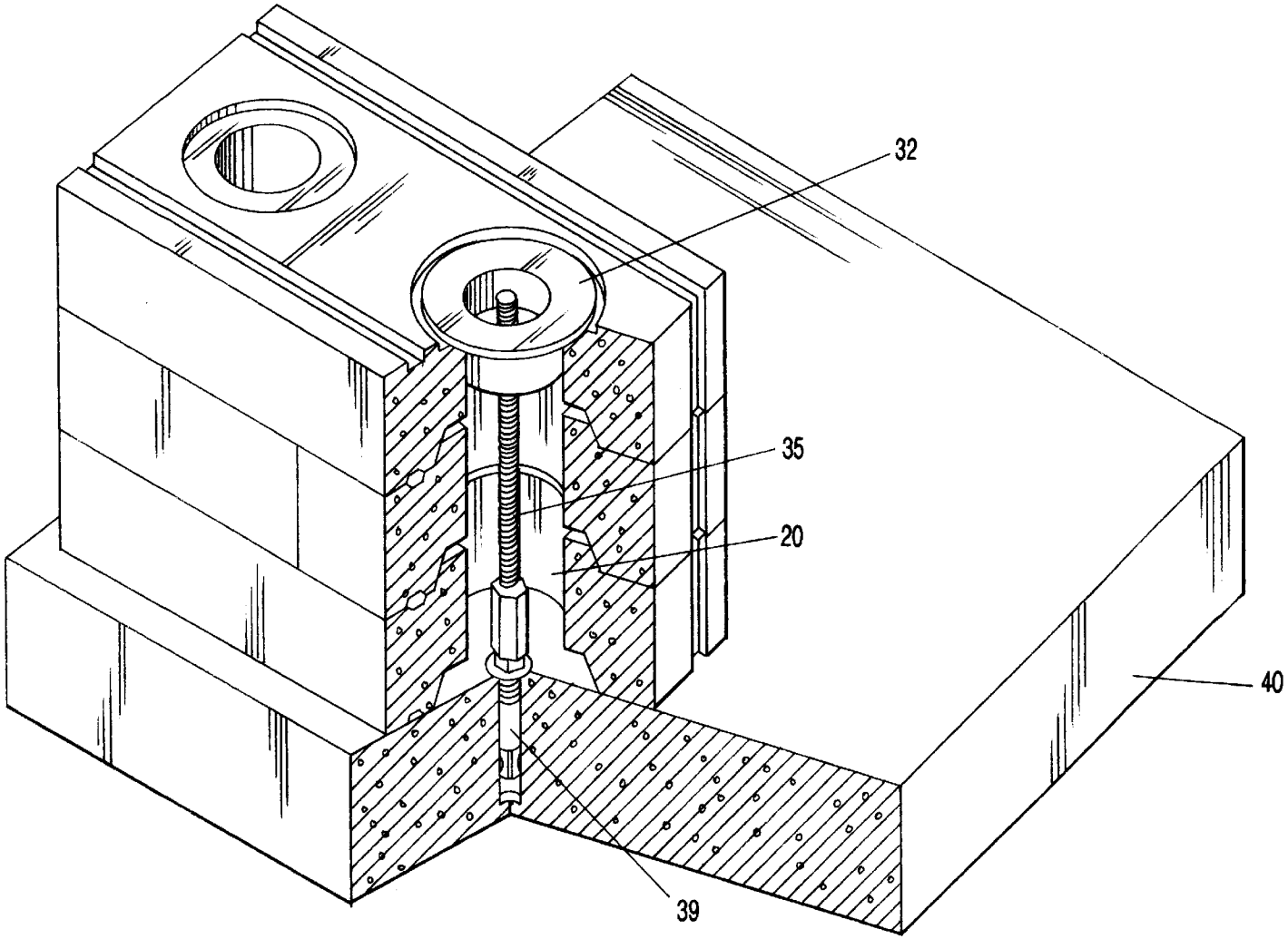
FIG. 4 is a cut-away perspective view of the building modules illustrating anchoring of the wall to a footing.
Figure 5B:
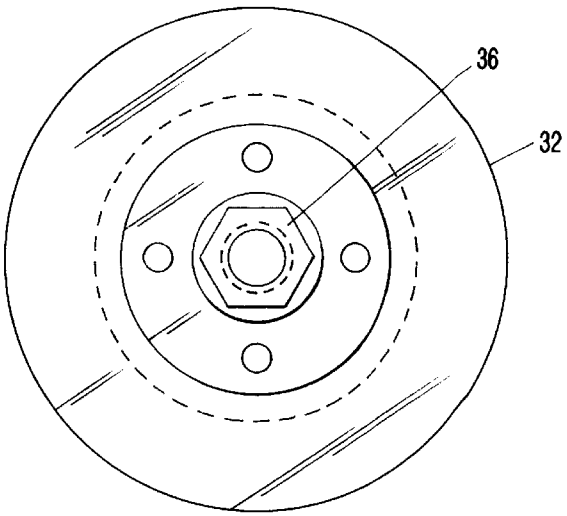
FIGS. 5(*a*)–(*c*) illustrate in perspective, top, and side views the compression retainer assembly of the invention.
Figure 5C:
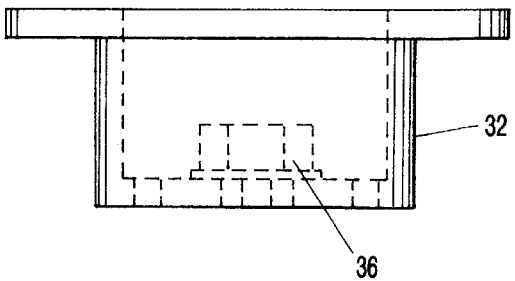
Figure 5A:
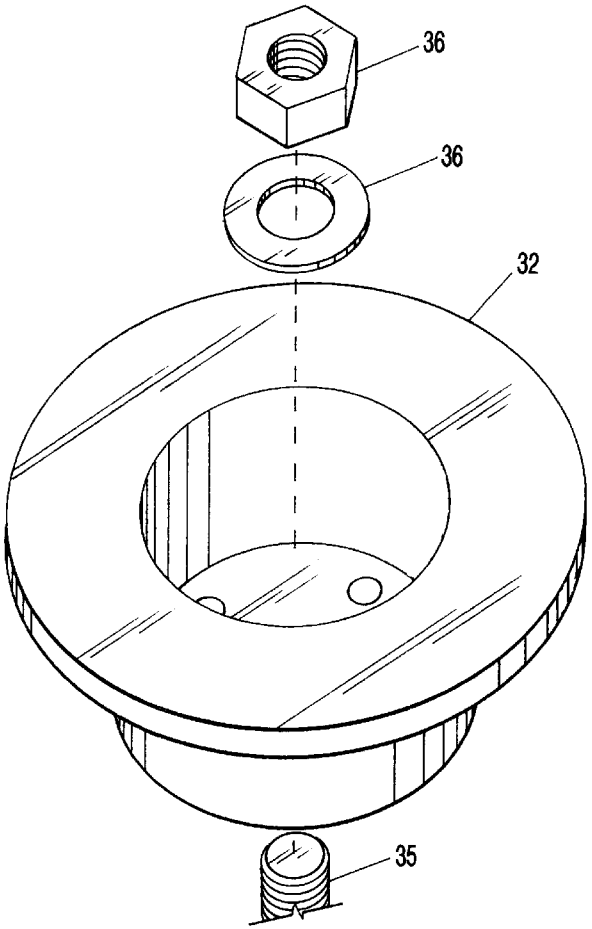
Figure 6:
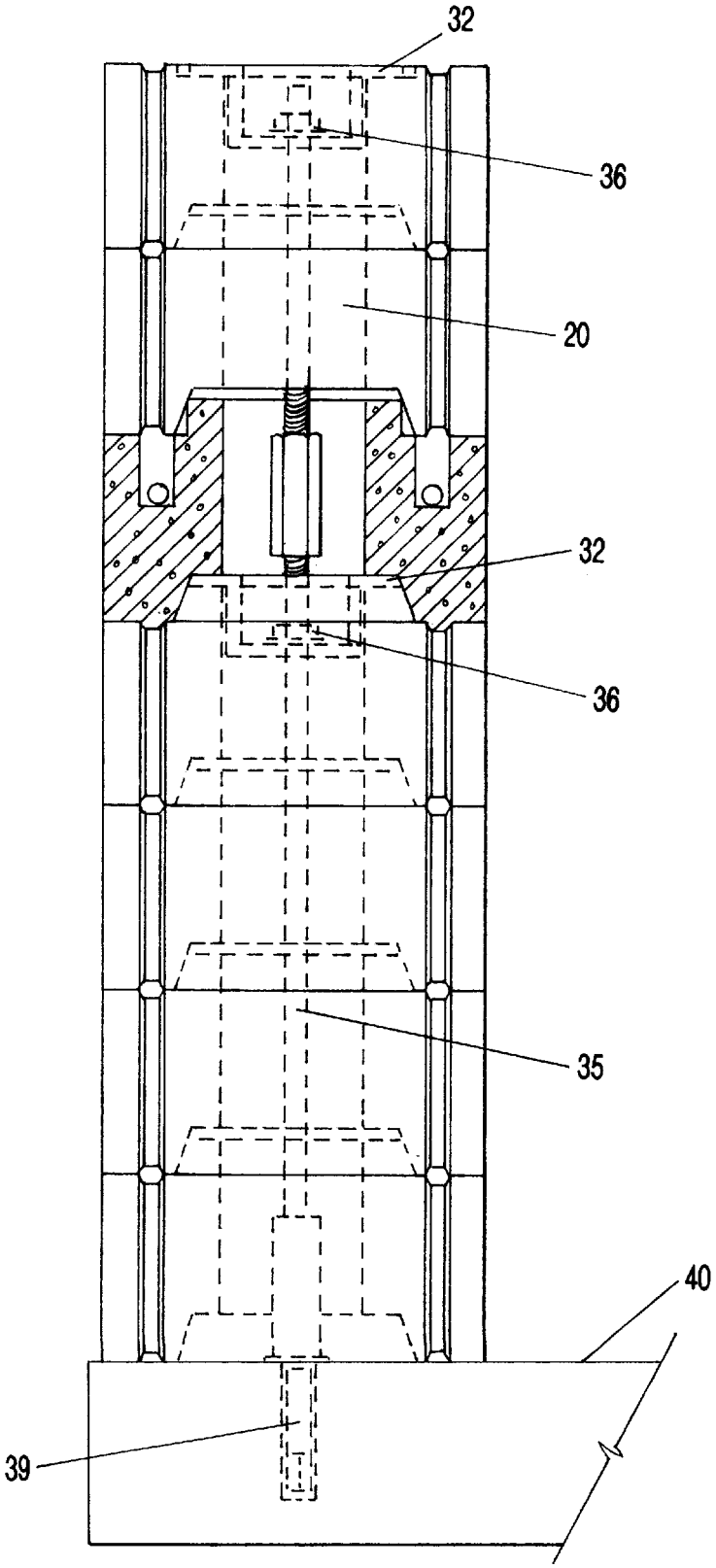
FIG. 6 is a cut-away view of the building modules according to the invention illustrating use of multiple compression retainers and attachment of the modules to a footing.

As previously mentioned, each module according to the invention (but not modules forming tops of walls, as seen in FIG. 3) has preferably on its top face truncated, round, conical, flat topped, coaxially hollow tenons that protrude upwards. On the bottom face of the system's components are mortises that are axially aligned with the tenons on the top face. The mortises and tenons are dimensioned so that when a block or other element of the system is placed within a constructed wall, they have the same dimensions and are equidistantly spaced along the length of each module. This common spacing allows the modules to be superimposed on top of each other in multiple layers, interlocking all the modules. Each mortise and tenon is axially aligned and coaxially hollow. One module positioned on top of another creates a set of tubular hollow chases within a constructed wall, having the same center-to-center dimension as the mortises and tenons. This design allows construction of a wide variety of architectural constructs.

A wall constructed from these modules has in it tubular hollow chases. These chases are equidistantly spaced and utilized for a variety of engineering requirements. Structurally, they are used as a means of reinforcing the completed design. For example, they may be filled with high psi concrete and a reinforcing rod in order to increase load bearing capability and structural integrity. Alternatively, all-thread rod may be used in conjunction with a cap and nut arrangement at the top of a wall. This all-thread rod is attached to the slab or foundation by an anchor or embedded threaded rod. The rod extends upward through the chase to the top of the wall. At the top, a cap and nut is installed on the all-thread rod. The nut is tightened to compress the structure to the slab. If this all-thread rod is installed in wet concrete, it creates a column of pre-stressed concrete. Plumbing, mechanical piping, electrical and data wiring may also be installed in these tubular chases.

The invention includes miniature embodiments of all the full size modules, such as in a LEGO® set. The purpose of the miniature modules is to facilitate the design and construction of a scale model of any proposed structure. The miniatures are preferably cast in durable plastic. Each miniature preferably includes an identifying number cast in it that corresponds to the part number of the full size module that it represents. This identification system allows a builder or designer to disassemble a scale model of a constructed design and produce an exact bill of materials required for the actual construction project, thus eliminating waste and cost.

Figure 2:
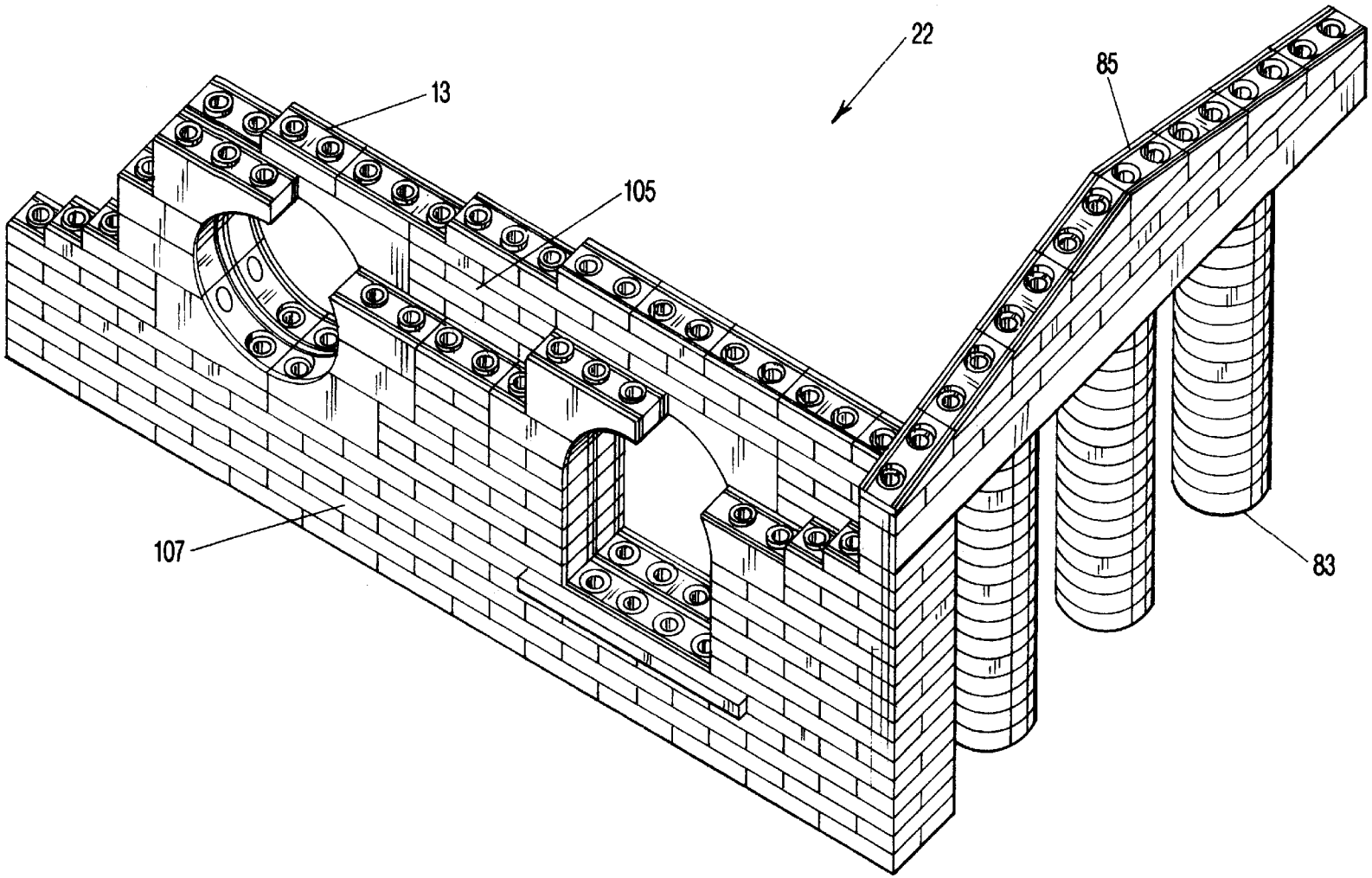
FIG. 2 is a perspective view of a double-layer wall embodying several possible architectural or design features of the invention and column design constructable according to the invention.
Figures 11A, 11B, 11C, 11D, 11E, 11F, 11G, 11H, 11I:
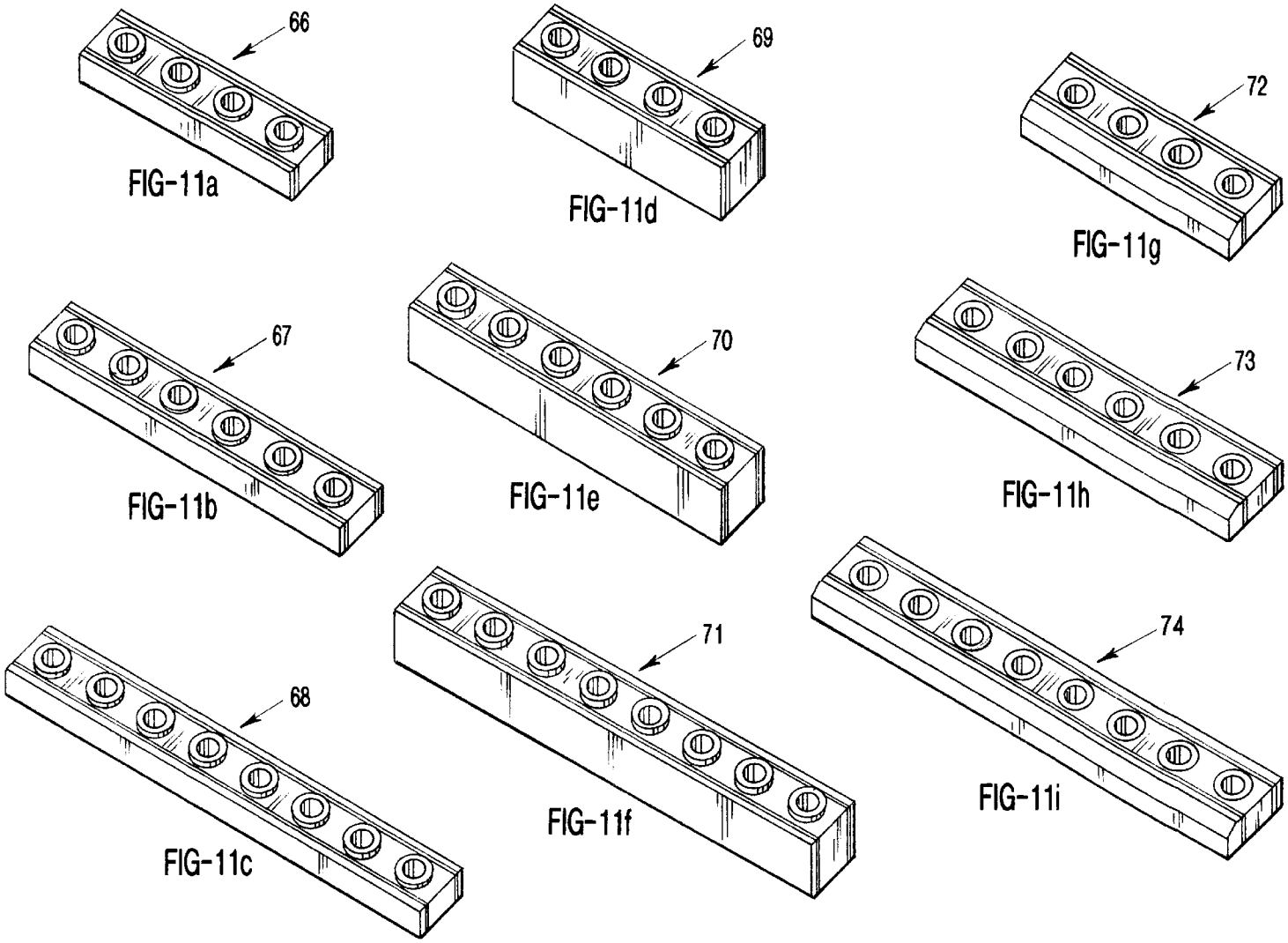
FIGS. 11(*a*)–(*i*) illustrate various multiple blocks or modules of the invention.
Figure 13:
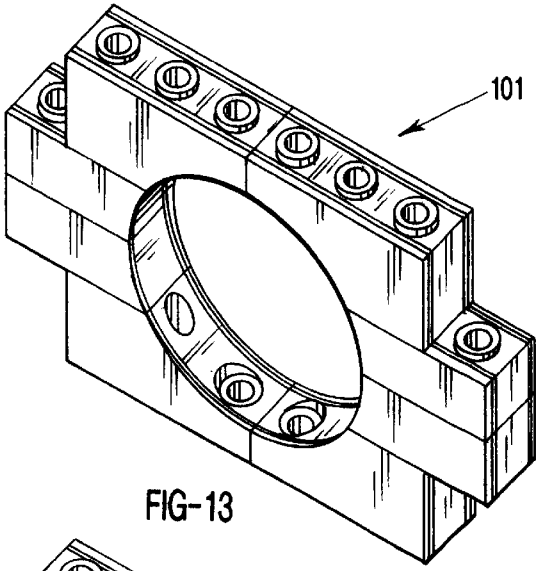
FIG. 13 illustrates in perspective view and in constructed form the round window or area of FIG. 12.
Figure 14:
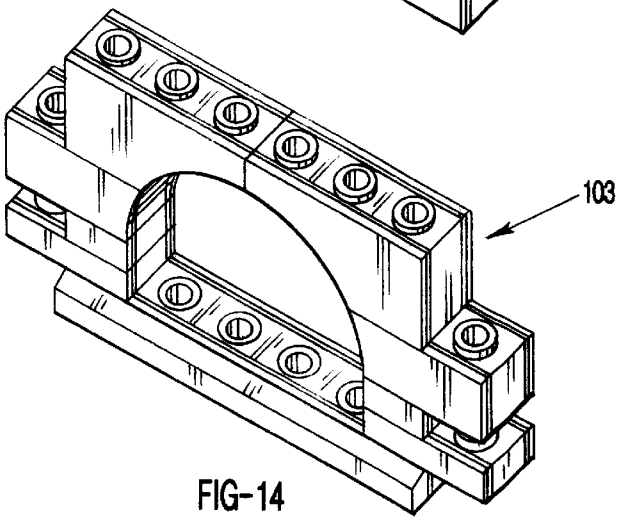
FIG. 14 illustrates in perspective view and in constructed form an arched window or area.
Figure 12:
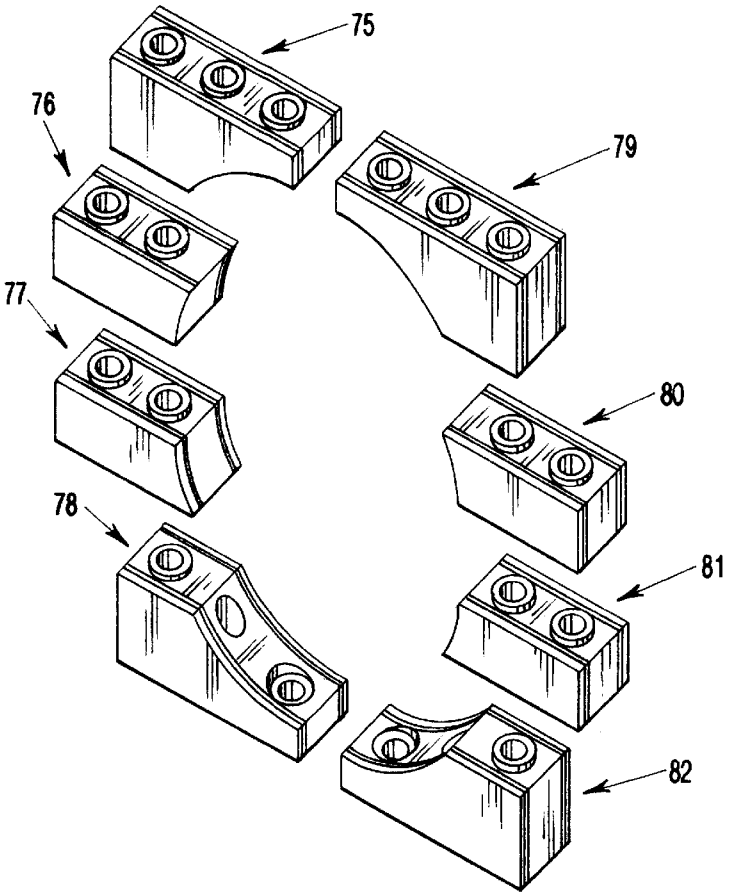
FIG. 12 illustrates in exploded perspective view a round window or area construct according to the invention.

FIGS. 1 and 2 are perspective views of a wall or other structure 13 depicted as assembled in a variety of architectural constructs. In FIG. 2, the assembled structure comprises two adjacent walls, inner wall 105 and outer wall 107. Certain module types are shown in situ in FIGS. 1 and 2, while those and others are shown individually in FIGS. 10–12: flat half module also known as flat wall half module 43; flush end flat module also known as flush end flat wall module 57; flush end flat half module also known as flush end flat wall half module 58; flat bond beam module also known as flat wall bond beam module 62; flat bond beam half module also known as flat wall bond beam half module 63; flat flush end bond beam module also known as flat wall flush end bond beam module 64; flat flush end bond beam half module also known as flat wall flush end bond beam half module 65; flat bullnose modules also known as flat wall bullnose modules 48 and 49; flat bullnose half modules also known as flat wall bullnose half modules 50 and 51; flat module with overhang also known as flat wall with overhang 52; flat half module with overhang also known as flat wall half module with overhang 53; right and left hand corner modules with overhang 41 and 42; flat eight inch radius corner modules (preferably 8" radius) 44 and 45; corner half modules (preferably 16" radius) 59 and 60; ninety degree module (preferably sixteen inch radius) 61; angle modules (e.g. 15 degrees) 54 and 55; double angle module (e.g., 30 degrees) 56; arch and circle components (e.g., 32") 75,76, 77,78,79,80,81,82 (also shown in use in circular window 101 in FIG. 13 and arched window 103 in FIG. 14); window and door header beam modules 66,67,68,69,70,71; window sill modules 72,73,74; column segment modules 83 (may vary in size, for example, having one, two, or five tenons/mortises); double bullnose flush end flat module also known as double bullnose flush end flat wall module 46; double bullnose flush end flat half module also known as double bullnose flush end flat wall half module 47; straight to radius interface module 84; and slanted, trapezoidal, or gable roof filler module 85. As may be understood by one skilled in the art, a number of modules varying by the principles, sizes, angles, degrees, and shapes, embodied in the set specifically set forth herein (or in the corresponding provisional application) may be constructed yet still fall within the invention.

Figure 9A:
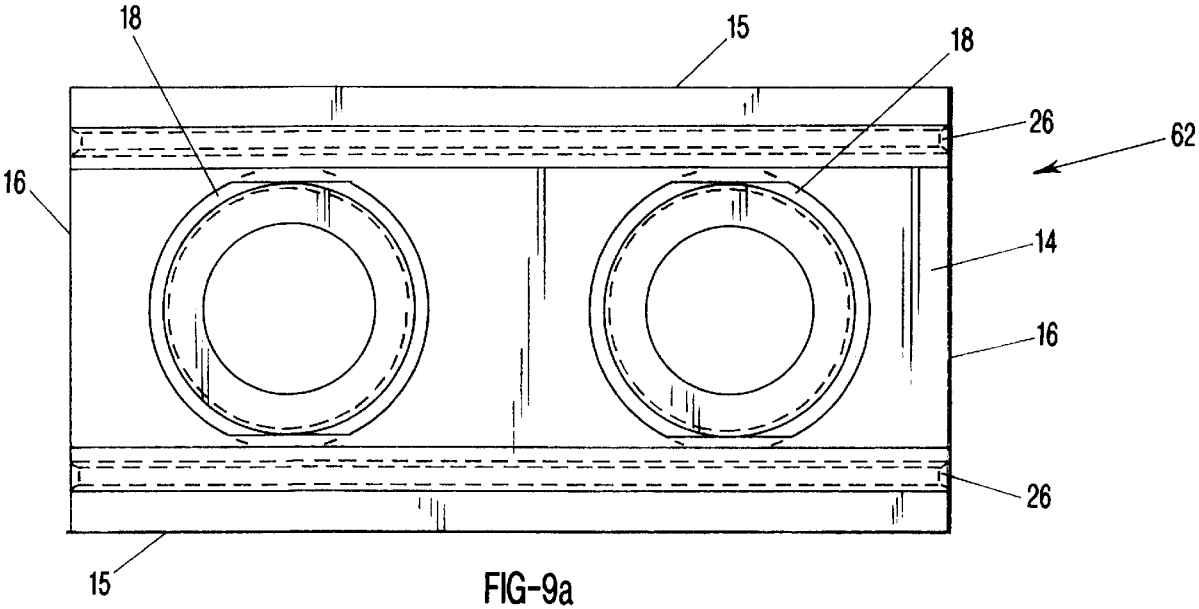
FIGS. 9(*a*)–(*c*) illustrate in top, side, and end views a bond beam module.
Figure 9B:
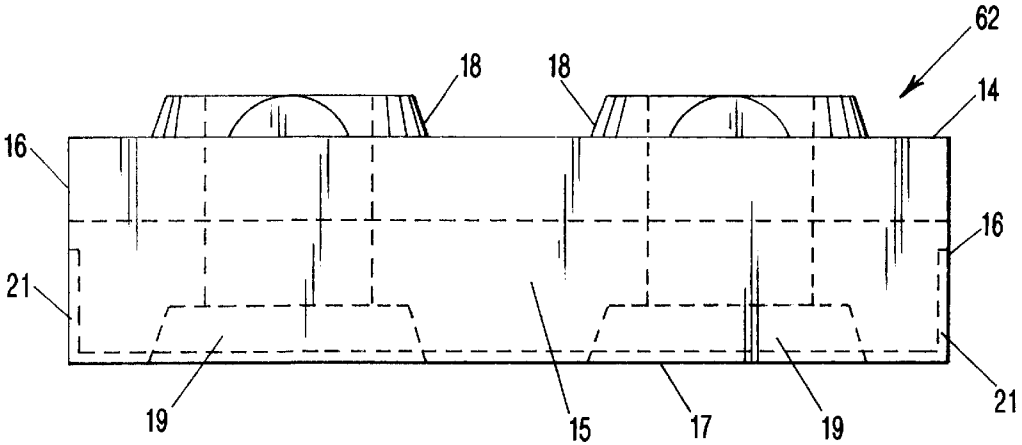
Figure 9C:
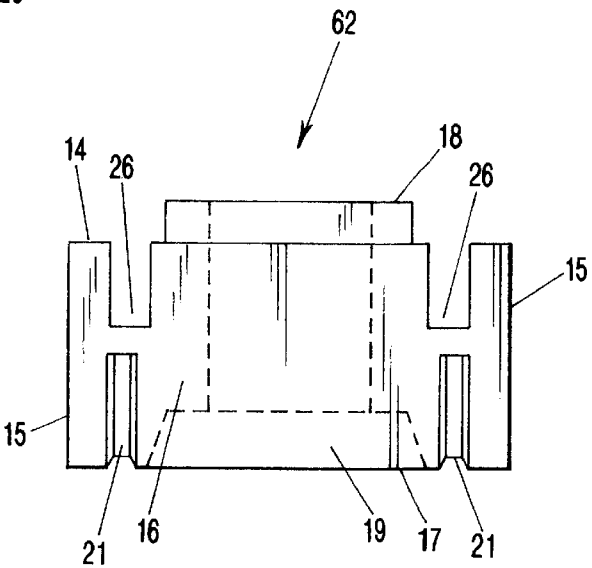
Figure 10A:
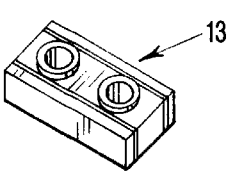
FIGS. 10(*a*)–(*z*) illustrate various single and half blocks of the invention.
Figure 10B:
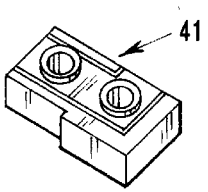
Figure 10C:
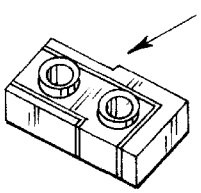
Figure 10D:
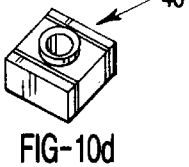
Figure 10E:
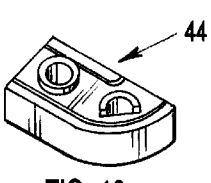
Figure 10F:
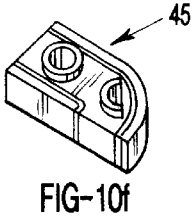
Figure 10G:
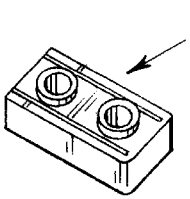
Figure 10H:
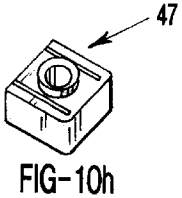
Figure 10I:
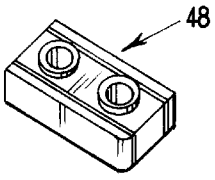
Figure 10J:
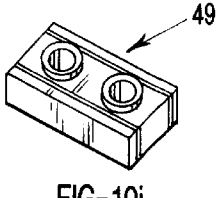
Figure 10K:
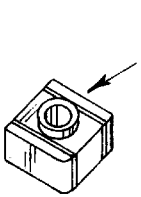
Figure 10L:
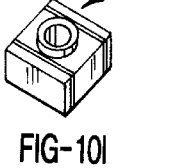
Figures 10M, 10N, 10O, 10P, 10Q, 10R, 10S, 10T, 10U, 10V, 10W, 10X, 10Y, 10Z:
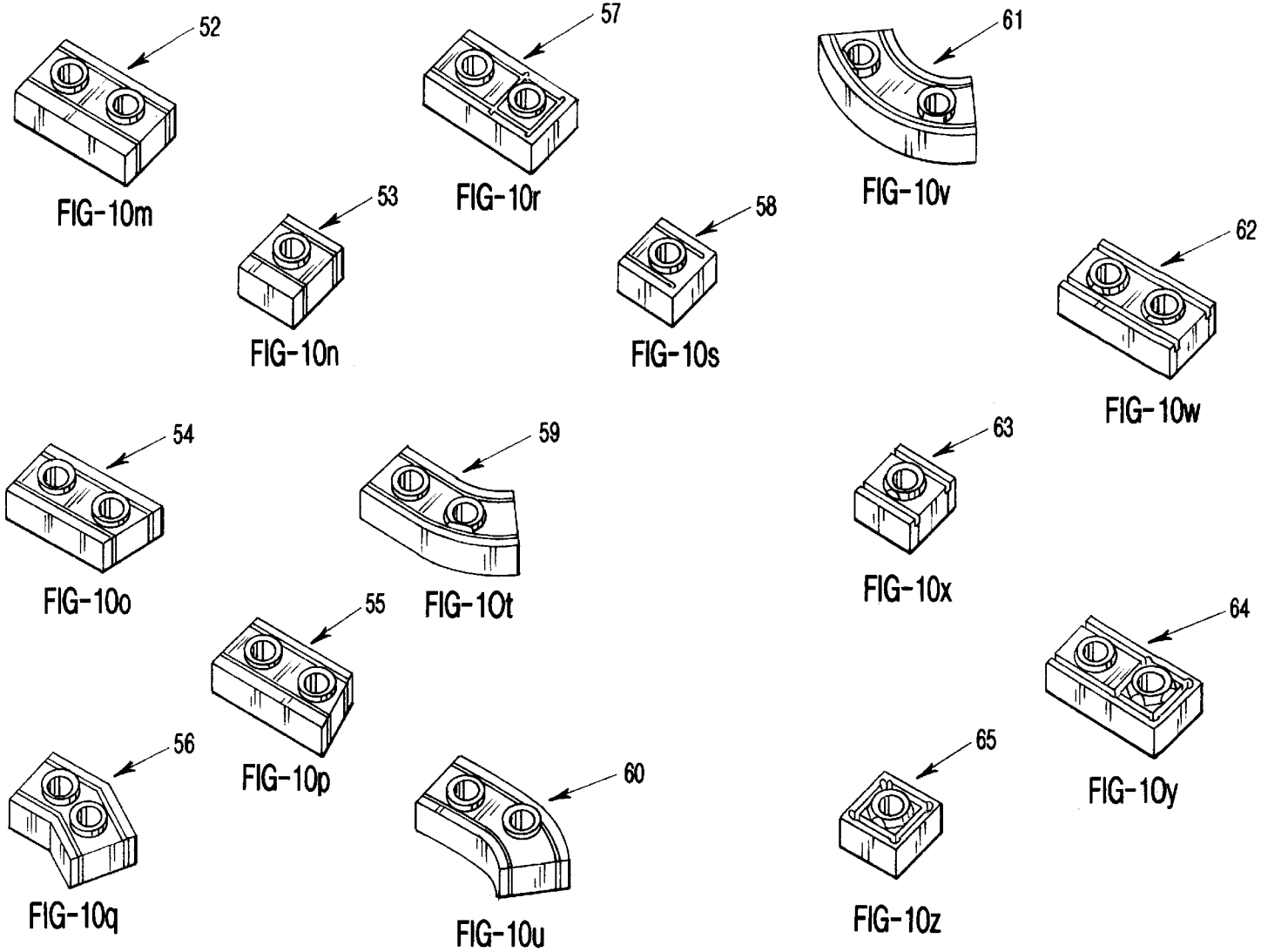

FIGS. 9(*a*)–(*c*) illustrate a flat bond beam module 62 of the invention (and FIG. 3 shows it in use), comprising a flat, horizontal top face 14, two vertical, parallel side faces 15, two vertical parallel end faces 16 and a flat horizontal bottom face 17, mortises 19, tenons 18, and two elongated insets 26 on the top face 14. There are two grooves 21 on the bottom face 17 that extend partially up each end face 16. There are grooves 21 on the bottom and end faces towards the side faces 15 in such a manner that they connect one to another partially encircling the module 62 with two grooves placed towards each side face 15, suitable for placing sealant 37. The insets 26 on the top face 14 are designed for the installation of reinforcing steel rod 27 or like support, and, preferably, mortar 38 for the purpose of creating a continuous bond beam within a wall or other structure.

Referring now to FIGS. 3–6, anchoring of the invention is described below. The drawings depict a vertical wall compression retainer 32 installed in the indendation 202 of a top module 204. The retainer is installed in conjunction with a support device such as a threaded rod 35 and nut and washer 36. The threaded rod extends through the cylindrical hollow spaces 20 within a wall constructed of modules to a footing or slab 40 where the rod is attached by an anchor 39 or like methods. When installed, the compression retainer applies downward force, thereby stabilizing the constructed design.

The modules according to the invention are preferably fabricated of materials such as those found in 1996 *Annual Book of ASTM Standards* vols. 04.05 and 04.02, and most preferably of materials disclosed in works of the Perlite Institute in New Jersey and mixes by Redco II of North Hollywood, Calif. Numerous other mixtures may be utilized in making the modules of the present invention, including cement made with vermiculite and other mix designs.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above are hereby incorporated by reference.

What is claimed is:

1. Building materials comprising modules comprising at least one mortise and tenon of substantially inverse shape, wherein said modules join at angles other than zero and ninety degrees and lateral ends of said modules are flush with lateral ends of adjacent modules throughout widths of said lateral ends, wherein a vertical cross-section through a center of said tenon is trapezoidal on its outer boundaries.

2. A structure constructed from interlocking modules of claim 1.

3. The building materials of claim 1 wherein said modules comprise grooves circumscribing said modules which are proximate corresponding grooves on modules placed on top or below said modules, and provide a means for which said modules are capable of being sealingly affixed to one another with sealant placed in said grooves.

4. The building materials of claim 1 wherein said modules comprise grooves in which elongated structural support elements are capable of being placed.

5. The building materials of claim 1 wherein a hollow space extends from said mortise on a face of said module to said tenon on an opposite face of said module.

6. The building materials of claim 5 additionally comprising a structural support member passing through said hollow space and a compression retainer securing said structural support member to said module.

7. The building materials of claim 1 additionally comprising a miniaturized plurality of units corresponding to shape and configuration of said modules, said units being useful in designing structures to be fabricated from said modules.

8. The building materials of claim 1 wherein said materials comprise a compressive strength of at least 250 psi.

9. The building materials of claim 1 wherein said modules comprise a perlite aggregate.

10. The building materials of claim 1 wherein said modules comprise a low density aggregate cementitious mix.

11. Building materials comprising interlocking modules comprising at least one mortise and tenon, wherein at least one module comprises a side face which is curvilinear and lateral ends of said modules are flush with lateral ends of adjacent modules throughout widths of said lateral ends.

12. A structure constructed from interlocking modules of claim 11.

13. The building materials of claim 11 wherein said modules comprise grooves which are proximate corresponding grooves on modules placed on top or below said modules, and provide a means for which said modules are capable of being sealingly affixed to one another with sealant placed in said grooves.

14. The building materials of claim 12 wherein said modules comprise grooves in which elongated structural support elements are capable of being placed.

15. The building materials of claim 11 wherein a hollow space extends from said mortise on a face of said module to said tenon on an opposite face of said module.

16. The building materials of claim 15 additionally comprising a structural support member passing through said hollow space and a compression retainer securing said structural support member to said module.

17. The building materials of claim 11 additionally comprising a miniaturized plurality of units corresponding to shape and configuration of said modules, said units being useful in designing structures to be fabricated from said modules.

18. The building materials of claim 11 wherein said tenon comprises a shape when viewed in top view of an incomplete circle on its outer boundaries.

19. Building materials comprising modules comprising at least one mortise and tenon, wherein said modules join at angles other than zero and ninety degrees and wherein said modules comprise grooves circumscribing said modules and which are proximate corresponding grooves on modules placed on top or below said modules, and provide a means for which said modules are capable of being sealingly affixed to one another with sealant placed in said grooves.

20. A structure constructed from interlocking modules of claim 19.

21. The building materials of claim 19 wherein said modules comprise grooves in which elongated structural support elements are capable of being placed.

22. The building materials of claim 19 wherein a hollow space extends from said mortise on a face of said module to said tenon on an opposite face of said module.

23. The building materials of claim 22 additionally comprising a structural support member passing through said hollow space and a compression retainer securing said structural support member to said module.

24. The building materials of claim 19 wherein said modules comprise a perlite aggregate.

25. The building materials of claim 24 wherein said modules comprise a low density aggregate cementitious mix.

26. Building materials comprising modules comprising at least one mortise and tenon, wherein said modules join at angles other than zero and ninety degrees and wherein a hollow space extends from said mortise on a face of said modules to said tenon on an opposite face of said modules, and said building materials additionally comprise a structural support member passing through said hollow space and a compression retainer securing said structural support member to said modules.

27. A structure constructed from interlocking modules of claim 26.

28. The building materials of claim 26 wherein said modules comprise grooves circumscribing said modules and which are proximate corresponding grooves on modules placed on top or below said modules, and provide means for which said modules are capable of being sealingly affixed to one another with sealant placed in said grooves.

29. The building materials of claim 26 wherein said modules comprise grooves in which elongated structural support elements are capable of being placed.

30. The building materials of claim 29 wherein said modules comprise a perlite aggregate.

31. The building materials of claim 26 wherein said modules comprise a low density aggregate cementitious mix.

32. Building materials comprising fully interlocking modules comprising at least one mortise and tenon, wherein at least one module comprises a side face which is curvilinear, and wherein a hollow space extends from said mortise on a face of said modules to said tenon on an opposite face of said modules, and said building materials additionally comprise a structural support member passing through said hollow space and a compression retainer securing said structural support member to said modules.

33. A structure constructed from interlocking modules of claim 32.

34. The building materials of claim 32 wherein said modules comprise grooves which are proximate corresponding grooves on modules placed on top or below said modules, by means of which said modules are capable of being sealingly affixed to one another with sealant placed in said grooves.

35. The building materials of claim 32 wherein said modules comprise grooves in which elongated structural support elements are capable of being placed.

36. The building materials of claim 32 wherein said modules comprise a perlite aggregate.

37. The building materials of claim 32 wherein said modules comprise a low density aggregate cementitious mix.

38. Building materials comprising modules comprising at least one mortise and tenon of substantially inverse shape, wherein said modules join at angles other than zero and ninety degrees and lateral ends of said modules are flush with lateral ends of adjacent modules throughout widths of said lateral ends, wherein said modules comprise grooves circumscribing said modules which are proximate corresponding grooves on modules placed on top or below said modules, and provide a means for which said modules are capable of being sealingly affixed to one another with sealant placed in said grooves.

39. Building materials comprising modules comprising at least one mortise and tenon of substantially inverse shape, wherein said modules join at angles other than zero and ninety degrees and lateral ends of said modules are flush with lateral ends of adjacent modules throughout widths of said lateral ends, wherein said modules comprise grooves in which elongated structural support elements are capable of being placed.

40. Building materials comprising modules comprising at least one mortise and tenon of substantially inverse shape, wherein said modules join at angles other than zero and ninety degrees and lateral ends of said modules are flush with lateral ends of adjacent modules throughout widths of said lateral ends, wherein a hollow space extends from said mortise on a face of said module to said tenon on an opposite face of said module.

41. The building materials of claim 40 additionally comprising a structural support member passing through said hollow space and a compression retainer securing said structural support member to said module.

* * * * *